US007614344B2

(12) United States Patent
Oda

(10) Patent No.: US 7,614,344 B2
(45) Date of Patent: Nov. 10, 2009

(54) ASSEMBLY METHOD FOR DEVICE EMPLOYING ELECTRIC IGNITION

(75) Inventor: Shingo Oda, Tatsuno (JP)

(73) Assignee: Daicel Chemical Industries, Ltd., Osaka (JP)

( * ) Notice: Subject to any disclaimer, the term of this patent is extended or adjusted under 35 U.S.C. 154(b) by 145 days.

(21) Appl. No.: 11/960,570

(22) Filed: Dec. 19, 2007

(65) Prior Publication Data

US 2008/0148983 A1 Jun. 26, 2008

Related U.S. Application Data

(60) Provisional application No. 60/884,562, filed on Jan. 11, 2007.

(30) Foreign Application Priority Data

Dec. 20, 2006 (JP) ..... 2006-342118

(51) Int. Cl.
*F42B 3/12* (2006.01)

(52) U.S. Cl. ..... 102/202.9; 102/202.12

(58) Field of Classification Search ..... 102/200–202.14
See application file for complete search history.

(56) References Cited

U.S. PATENT DOCUMENTS

| | | | | |
|---|---|---|---|---|
| 3,496,496 | A * | 2/1970 | Fiebel et al. | 333/33 |
| 5,602,359 | A * | 2/1997 | Hambro et al. | 102/202.5 |
| 5,732,634 | A * | 3/1998 | Flickinger et al. | 102/202.5 |
| 6,718,884 | B1 | 4/2004 | Yabuta et al. | |
| 7,210,703 | B2 * | 5/2007 | Young et al. | 280/741 |
| 2005/0189753 | A1 | 9/2005 | Kato et al. | |
| 2006/0017269 | A1 | 1/2006 | Kuroda et al. | |

FOREIGN PATENT DOCUMENTS

| | | | |
|---|---|---|---|
| EP | 1564087 | B1 | 9/2007 |
| EP | 1621413 | B1 | 9/2007 |
| JP | 2001-016500 | A | 1/2001 |
| JP | 2001-165600 | A | 6/2001 |
| JP | 2003-267186 | A | 9/2003 |
| JP | 2005-225274 | A | 8/2005 |
| JP | 2006-035970 | A | 2/2006 |

* cited by examiner

*Primary Examiner*—Michael Carone
*Assistant Examiner*—Reginald Tillman, Jr.
(74) *Attorney, Agent, or Firm*—Birch, Stewart, Kolasch and Birch, LLP

(57) ABSTRACT

The present invention is a method of assembling a device employing electric ignition by comprising assembling an igniter assembly in the device, the igniter assembly having an electric igniter provided with a first electroconductive pin and a second electroconductive pin, connected to a power source, the method comprising steps of:

forming two measurement circuits by using the first electroconductive pin and the second electroconductive pin as a measurement terminal on one end side, respectively, and using another member provided in the igniter assembly as a terminal on the other end side with a pass through a dielectric provided in the igniter assembly, measuring pure resistances and/or impedances of the two measurement circuits, respectively, by applying a high frequency thereto separately, distinguishing the first electroconductive pin from the second electroconductive pin from a magnitude relationship (difference) between the measured pure resistance and/or impedance values, and then, disposing the igniter assembly to the device such that the first electroconductive pin and the second electroconductive pin correspond to predetermined power source electrodes, respectively.

6 Claims, 2 Drawing Sheets

ASSEMBLY METHOD FOR DEVICE EMPLOYING ELECTRIC IGNITION

This nonprovisional application claims priority under 35 U.S.C. § 119(a) on Patent Application No. 2006-342118 filed in Japan on 20 Dec. 2006 and under 35 U.S.C. § 119(e) on U.S. Provisional Application No. 60/884,562 filed on 11 Jan. 2007, which are incorporated by reference.

BACKGROUND OF INVENTION

1. Field of Invention

The present invention relates to an assembly method for a device that employs electric ignition, such as an air bag device, and a method of distinguishing between two electroconductive pins provided in an electric igniter.

2. Description of Related Art

In an electric igniter having two electroconductive pins (a center pin and an eyelet pin) for electrifying a heating wire (a body that generates heat through electric resistance) or an igniter assembly using the electric igniter, positive and negative electrodes are usually connected to predetermined electroconductive pins, and when a positive or negative electrode is connected to the wrong electroconductive pin, a defective product is obtained.

FIG. 1 illustrates the structure of a known igniter assembly 10. An electric igniter 20 is coupled integrally to a metallic igniter collar 30 by a resin 31.

In the electric igniter 20, a center pin 21*a* is insulated from a metallic header (eyelet) 23 by a glass member 22 and connected to a heat-generating body (bridge wire) 24. An eyelet pin 21*b* is connected to the eyelet 23 and connected to the heat-generating body (bridge wire) 24 via the eyelet 23. An ignition agent 26 is charged into a tubular spacer 25 so as to press against the heat-generating body (bridge wire) 24. The eyelet 23 and the tubular spacer 25 are covered from the outside by a metallic cover 27, together forming an ignition portion of the electric igniter 20. Further, the metallic cover 27 of the ignition portion is covered by a resin cover 28 having an electric insulation property. A space 29 serves as a space for inserting a connector plug having a lead wire.

As shown in FIG. 1, the igniter assembly 10 has a structure in which a resin 31 is molded between the igniter 20 and igniter collar 30, and therefore it is impossible to distinguish between the center pin 21*a* and the eyelet pin 21*b* from the outer form thereof.

Conventionally, the center pin 21*a* is distinguished from the eyelet pin 21*b* by means of X-ray projection, but X-ray projectors and X-ray lamps are both expensive, leading to an increase in maintenance costs that is reflected in the manufacturing costs of the igniter JP-A No. 2001-165600 and JP-A No. 2006-35970 may be related arts of the present invention.

SUMMARY OF INVENTION

One of the inventions provides a method of assembling a device employing electric ignition by comprising assembling an igniter assembly in the device, the igniter assembly having an electric igniter provided with a first electroconductive pin and a second electroconductive pin, connected to a power source, the method comprising steps of:

forming two measurement circuits by using the first electroconductive pin and the second electroconductive pin as a measurement terminal on one end side, respectively, and using another member provided in the igniter assembly as a terminal on the other end side with a pass through a dielectric provided in the igniter assembly, measuring pure resistances and/or impedances of the two measurement circuits, respectively, by applying a high frequency thereto separately, distinguishing the first electroconductive pin from the second electroconductive pin from a magnitude relationship (difference) between the measured pure resistance and/or impedance values, and then, disposing the igniter assembly to the device such that the first electroconductive pin and the second electroconductive pin correspond to predetermined power source electrodes, respectively.

In other words, it is an assembly method for a device employing electric ignition, including a step of attaching an igniter assembly to the device, wherein the igniter assembly has an electric igniter having a first electroconductive pin and a second electroconductive pin for connecting the electric igniter to a power source, two measurement circuits passing through a dielectric provided in the igniter assembly are formed such that the first electroconductive pin or the second electroconductive pin serves as a measurement terminal on one end side and another member provided in the igniter assembly serves as a terminal on another end side, and a high frequency is introduced separately into the two measurement circuits to measure pure resistances and/or impedances, and the first electroconductive pin is distinguished from the second electroconductive pin from a magnitude relationship (difference) between the measured pure resistance and/or impedance values, whereupon the igniter assembly is attached to the device such that the first electroconductive pin and the second electroconductive pin correspond to predetermined power source electrodes.

Another one of the inventions provides a method of distinguishing between a first electroconductive pin and a second electroconductive pin, provided in an electric igniter in an igniter assembly including the electric igniter, comprising steps of:

forming two measurement circuits passing through a dielectric, provided in the igniter assembly, such that the first electroconductive pin and the second electroconductive pin serves as a measurement terminal on one end side and another member provided in the igniter assembly serves as a terminal on another end side; and measuring pure resistances and/or impedances of the two measurement circuits, respectively, by applying a high frequency thereto separately, and distinguishing between the first electroconductive pin and the second electroconductive pin from a magnitude relationship (difference) between the measured pure resistance and/or impedance values.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF INVENTION

Figure 1:
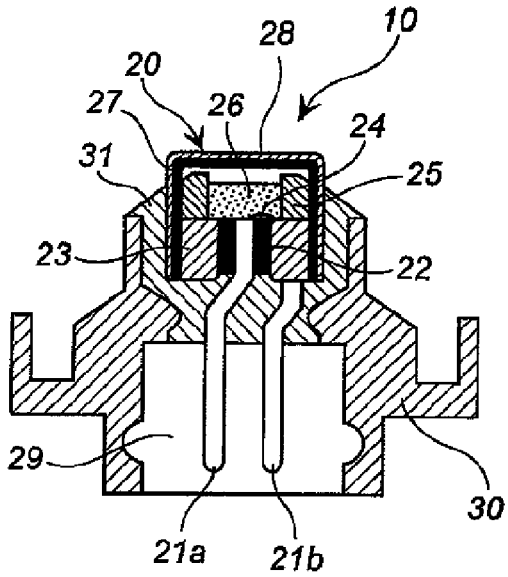
FIG. 1 shows a vertical cross-sectional view of a known igniter assembly to which the present invention is applied.

The present invention provides an assembly method for a device that employs electric ignition, such as an air bag device, with which it is possible to distinguish between two electroconductive pins provided in an igniter assembly and an electric igniter, thereby improving the reliability of the device.

The present invention also provides a method of distinguishing between two electroconductive pins provided in an igniter assembly and an electric igniter.

By employing a commercially available high-frequency resistance measuring device, the sign, positive or negative, of the two electroconductive pins can be confirmed easily. Hence, in comparison with a conventional method employing an X-ray projector, manufacturing costs can be reduced.

Various devices, such as an occupant-protecting air bag device (a gas generator for an air bag) or a seatbelt pretensioner installed in a vehicle such as an automobile, may be cited as examples of a device employing electric ignition.

An igniter assembly in which a collar member is incorporated into a lower portion (including a part of the electroconductive pins) of an electric igniter via a resin, and a gas generator in which a cap member is fixed to the collar member of the igniter assembly and a gas generating agent is charged between the electric igniter and the cap, or in other words a gas generator having an igniter assembly, may be cited as examples of an igniter assembly.

The present invention preferably provides the assembly method, wherein the dielectric is an electric insulation cover covering an ignition portion of the electric igniter.

The present invention preferably provides the assembly method, wherein the dielectric is a resin which integrally couples a metallic igniter collar to the electric igniter.

By employing a commercially available high-frequency resistance measuring device, the sign, positive or negative, of the two electroconductive pins can be confirmed easily. Hence, in comparison with a conventional method employing an X-ray projector, manufacturing costs can be reduced.

The present invention preferably provides the method of distinguishing between a first electroconductive pin and a second electroconductive pin, wherein the dielectric is an electric insulation cover covering an ignition portion of the electric igniter.

The present invention preferably provides the method of distinguishing between a first electroconductive pin and a second electroconductive pin, wherein the dielectric is a resin which integrally couples a metallic igniter collar to the electric igniter.

By applying the distinguishing method of the present invention, it is possible to distinguish between two electroconductive pins provided in an igniter assembly easily and at a lower cost than a conventional method. Therefore, when assembling an automobile safety device such as an air bag device (a gas generator for an air bag) or a seatbelt pretensioner, the respective electroconductive pins can be attached appropriately to the corresponding ignition power source electrodes, without confusing the two electroconductive pins, as a result of which the reliability of the device is improved.

Figure 2:
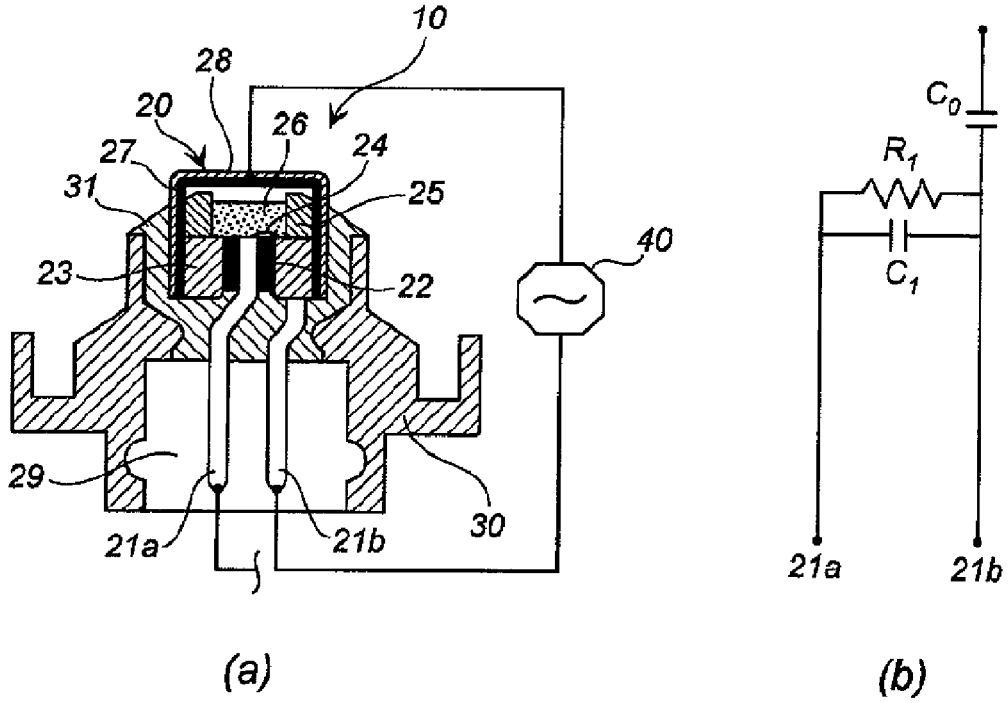
In FIG. 2, (a) shows a sectional view of an igniter assembly for illustrating an assembly method and a distinguishing method of the present inventions and a schematic view of high-frequency resistance measurement circuits including the igniter assembly, and (b) shows an equivalent circuit diagram of the igniter assembly shown in (a) in high-frequency resistance measurement; and In FIG. 3, (a) shows a sectional view of a gas generator having an igniter assembly for illustrating an assembly method and a distinguishing method of the present invention, and a schematic view of high-frequency resistance measurement circuits including the igniter assembly, and (b) shows an equivalent circuit diagram of the gas generator shown in (a) in high-frequency resistance measurement.

EMBODIMENT OF INVENTION (1) Assembly Method or Distinguishing Method in FIG. 2

FIG. 2(*a*) is a sectional view of an igniter assembly for illustrating an assembly method and a distinguishing method of the present invention, and a schematic view of high-frequency resistance measurement circuits including the igniter assembly. FIG. 2(*b*) is an equivalent circuit diagram of high-frequency resistance measurement performed on the igniter assembly shown in FIG. 2(*a*).

The igniter assembly 10 is identical to the igniter assembly shown in FIG. 1, in which an ignition portion (the metallic cover 27 and the interior thereof) of the electric igniter 20 is covered by the resin cover 28 (electric insulation cover), which has an electric insulation property.

In high-frequency resistance measurement of the igniter assembly 10, a first measurement circuit having the center pin (first electroconductive pin) 21*a* as a terminal on one end side and the resin cover 28 as a terminal on the other end side and a second measurement circuit having the eyelet pin (second electroconductive pin) 21*b* as a terminal on one end side and the resin cover 28 as a terminal on the other end side are formed. In these circuits, the resin cover 28 and the glass member 22 serve as dielectrics.

A high-frequency resistance measuring device 40 is disposed on the first measurement circuit and second measurement circuit. A device described in Examples may be used as the high-frequency resistance measuring device.

When a high frequency is introduced into the first measurement circuit (between the resin cover 28 and the center pin 21*a*) by the high-frequency resistance measuring device 40, the resin cover (dielectric) 28 becomes a capacitor C0, the glass member 22 becomes a capacitor C1, the bridge wire 24 becomes a resistor R1 (2Ω), and the metallic cover 27, eyelet 23 and center pin 21*a* become non-resistive conductors.

Meanwhile, when a high frequency is introduced into the second measurement circuit (between the resin cover 28 and the eyelet pin 21*b*) by the high-frequency resistance measuring device 40, the resin cover (dielectric) 28 becomes a capacitor C0, and the metallic cover 27, eyelet 23 and eyelet pin 21*b* become non-resistive conductors.

Hence, the first measurement circuit and second measurement circuit differ in circuit configuration and the path along which the high frequency flows, and therefore also differ in high-frequency resistance (pure resistance and/or impedance). Therefore, when an appropriate high frequency is selected and measurement is performed at this high frequency, a magnitude relationship occurs between the measured high-frequency resistance values. Accordingly, by measuring the high-frequency resistance (pure resistance and/or impedance) at different high frequencies in advance with respect to an igniter assembly (measurement reference product) having a specific structure and serving as a measurement subject, confirming the frequency of a high frequency at which a magnitude relationship occurs between the high-frequency resistance values measured in relation to the first measurement circuit and second measurement circuit, and using this high frequency to measure the high-frequency resistances (pure resistances and/or impedances) of the first measurement circuit and second measurement circuit, it is possible to distinguish between the center pin (first electroconductive pin) and eyelet pin (second electroconductive pin) easily from the magnitude relationship between the high-frequency resistance values of the first measurement circuit and second measurement circuit.

After distinguishing between the two electroconductive pins (the center pin and eyelet pin) of the igniter assembly in this manner, the igniter assembly is incorporated into a known gas generator (for example, a gas generator used in a seatbelt pretensioner, disclosed in JP-A No. 2005-225274, or an air bag gas generator incorporated with an igniter assembly formed by integrating an igniter and a metallic collar by interposing resin therebetween, disclosed in FIGS. 1, 6 and 8 of JP-A No. 2001-16500), whereupon the gas generator is incorporated into an automobile safety device (for example, an air bag device or a seatbelt pretensioner) and installed in a vehicle. When an ignition power source (battery) is connected to the two electroconductive pins of the igniter assembly at this time, confusion between the positive and negative electrodes is eliminated. As a result, the reliability of the finally assembled automobile safety device is improved.

Figure 3:
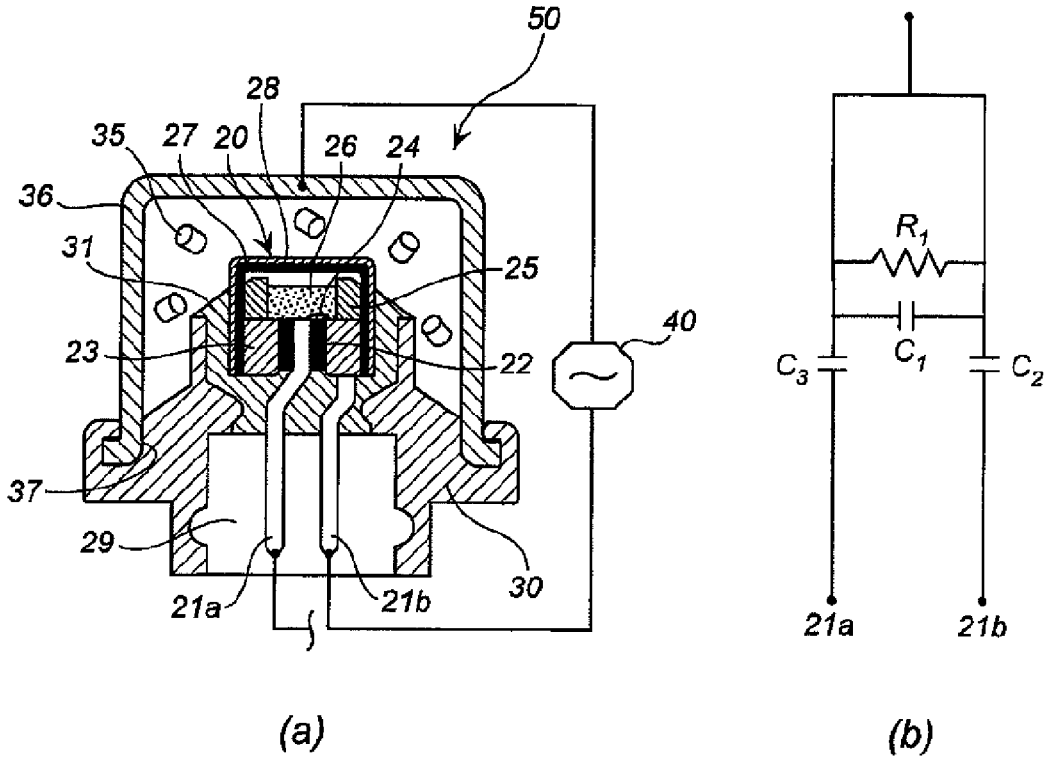

(2) Assembly Method and Distinguishing Method in FIG. 3

FIG. 3(*a*) is a sectional view of an igniter assembly for illustrating an assembly method and a distinguishing method of the present invention, and a schematic view of high-frequency resistance measurement circuits including the igniter assembly. FIG. 3(*b*) is an equivalent circuit diagram of high-frequency resistance measurement performed on the igniter assembly shown in FIG. 3(*a*).

In FIG. 3(*a*), an opening portion 37 of a metallic cap 36 is fixed to the metallic collar 30 of the igniter assembly 10 shown in FIG. 1, and a molded body of gas generating agent 35 is charged into an interior space of the metallic cap 36.

In high-frequency resistance measurement of a gas generator 50, a first measurement circuit having the center pin 21*a* as a terminal on one end side and the metallic cap 36 as a terminal on the other end side and a second measurement circuit having the eyelet pin 21*b* as a terminal on one end side and the metallic cap 36 as a terminal on the other end side are formed. In these circuits, the resin 31 and the glass member 22 serve as dielectrics.

When a high frequency is introduced into the first measurement circuit (between the metallic cap 36 and the center pin 21*a*) by the high-frequency resistance measuring device 40, the glass member 22 becomes a capacitor C1, the resin (the resin between the center pin 21*a* and the metallic collar 30) 31 becomes a capacitor C3, the bridge wire 24 becomes a resistor R1 (2Ω), and the metallic cap 36, metallic collar 30 and center pin 21*a* become non-resistive conductors.

Meanwhile, when a high frequency is introduced into the second measurement circuit (between the metallic cap 36 and the eyelet pin 21*b*) by the high-frequency resistance measuring device 40, the glass member 22 becomes a capacitor C1, the resin (the resin between the eyelet pin 21*b* and the metallic collar 30) 31 becomes a capacitor C2, the bridge wire 24 becomes a resistor R1 (2Ω), and the metallic cap 36, metallic collar 30 and eyelet pin 21*b* become non-resistive conductors.

Hence, the first measurement circuit and second measurement circuit differ in the path along which the high frequency flows (in the first measurement circuit, the high frequency flows along the path of the capacitor C3, and in the second measurement circuit, the high frequency flows along the path of the capacitor C2), and therefore also differ in high-frequency resistance (pure resistance and/or impedance). Therefore, when an appropriate high frequency is selected and measurement is performed at this high frequency, a magnitude relationship occurs between the measured high-frequency resistance values. The reason for this is that in the gas generator shown in FIG. 3(*a*), the center pin 21*a* and the eyelet pin 21*b* bend in the same direction in respective parts thereof that are covered by the resin 31, and in these resin 31 parts, the distance between the center pin 21*a* and metallic collar 30 differs from the distance between the eyelet pin 21*b* and metallic collar 30. Hence, the capacitance of the capacitor C3 differs from the capacitance of the capacitor C2.

Accordingly, by measuring the high-frequency resistance (pure resistance and/or impedance) at different high frequencies in advance with respect to an igniter assembly (measurement reference product) having a specific structure and serving as a measurement subject, confirming the frequency of a high frequency at which a magnitude relationship occurs between the high-frequency resistance values measured in relation to the first measurement circuit and second measurement circuit, and using this high frequency to measure the high-frequency resistances (pure resistances and/or impedances) of the first measurement circuit and second measurement circuit, it is possible to distinguish between the center pin (first electroconductive pin) and eyelet pin (second electroconductive pin) easily from the magnitude relationship between the high-frequency resistance values of the first measurement circuit and second measurement circuit.

After distinguishing between the two electroconductive pins (the center pin and eyelet pin) of the gas generator in this manner, the gas generator is incorporated into a known automobile safety device (for example, a pretensioner of a seatbelt retractor, disclosed in JP-A No. 2003-267186), whereupon the gas generator is incorporated into an air bag device (for example, a seatbelt pretensioner) and then installed in a vehicle. When an ignition power source (battery) is connected to the two electroconductive pins of the igniter assembly at this time, confusion between the positive and negative electrodes is eliminated. As a result, the reliability of the finally assembled automobile safety device is improved.

EXAMPLES

Example 1

Igniter Assembly of FIG. 2

The two measurement circuits (first measurement circuit and second measurement circuit) shown in FIGS. 2(*a*) and 2(*b*) were prepared, whereupon the pure resistance value (Ω) and impedance (Ω) were measured while varying the frequency, as shown in Tables 1 and 2. A "Network Analyzer, Model: 8753ES, Frequency Range: 30 kHz to 3 GHz", manufactured by Agilent Technologies Inc., was used as the high-frequency resistance measuring device.

TABLE 1

| | Pure Resistance(Ω) | | |
|---|---|---|---|
| Frequency (MHz) | First measurement circuit | Second measurement circuit | Difference |
| 3 | 202.500 | 233.500 | −31.000 |
| 4 | 156.000 | 173.500 | −17.500 |
| 5 | 116.000 | 134.130 | −18.130 |
| 6 | 89.250 | 106.630 | −17.380 |
| 7 | 73.130 | 86.500 | −13.370 |
| 8 | 57.880 | 70.750 | −12.870 |
| 9 | 45.690 | 58.190 | −12.500 |
| 10 | 37.810 | 47.940 | −10.130 |
| 15 | 8.880 | 16.690 | −7.810 |
| 20 | 13.219 | 16.906 | −3.687 |
| 30 | 8.188 | 9.313 | −1.125 |

TABLE 1-continued

| Frequency (MHz) | Pure Resistance(Ω) First measurement circuit | Second measurement circuit | Difference |
|---|---|---|---|
| 40 | 12.000 | 11.859 | 0.141 |
| 50 | 9.578 | 8.797 | 0.781 |
| 60 | 5.570 | 4.297 | 1.273 |
| 70 | 5.336 | 4.313 | 1.023 |
| 80 | 6.875 | 6.953 | −0.078 |
| 90 | 7.938 | 8.914 | −0.976 |
| 100 | 7.031 | 6.340 | 0.691 |
| 150 | 4.141 | 2.277 | 1.864 |
| 200 | 5.466 | 3.151 | 2.315 |
| 300 | 77.711 | 75.297 | 2.414 |

TABLE 2

| Frequency (MHz) | Impedance(Ω) First measurement circuit | Second measurement circuit | Difference |
|---|---|---|---|
| 3 | 5435.074 | 5224.221 | 210.853 |
| 4 | 4108.962 | 3987.177 | 121.785 |
| 5 | 3296.841 | 3223.692 | 73.149 |
| 6 | 2757.245 | 2705.502 | 51.743 |
| 7 | 2365.631 | 2334.103 | 31.528 |
| 8 | 2074.208 | 2049.721 | 24.487 |
| 9 | 1844.666 | 1827.127 | 17.539 |
| 10 | 1662.430 | 1648.097 | 14.333 |
| 15 | 1110.636 | 1106.926 | 3.710 |
| 20 | 826.046 | 825.113 | 0.933 |
| 30 | 543.622 | 544.490 | −0.868 |
| 40 | 399.520 | 400.176 | −0.656 |
| 50 | 312.777 | 312.924 | −0.147 |
| 60 | 254.551 | 254.406 | 0.145 |
| 70 | 209.048 | 208.295 | 0.753 |
| 80 | 170.549 | 168.573 | 1.976 |
| 90 | 136.701 | 133.059 | 3.642 |
| 100 | 127.624 | 126.030 | 1.594 |
| 150 | 48.491 | 47.547 | 0.944 |
| 200 | 14.943 | 15.883 | −0.940 |
| 300 | 193.913 | 198.959 | −5.046 |

As is evident from Tables 1 and 2, a magnitude relationship occurred clearly in both the pure resistance and the impedance between the first measurement circuit (between the resin cover 28 and the center pin 21*a*) and the second measurement circuit (between the resin cover 28 and the eyelet pin 21*b*) at each frequency. It is therefore possible to distinguish between the two electroconductive pins of the igniter assembly easily. Hence, confusion does not occur between the positive and negative electrodes of the ignition power source that is connected to the two electroconductive pins when incorporating the igniter assembly in a device, and the device can be assembled reliably and easily.

As shown in Tables 1 and 2, the measurement values of the pure resistance and impedance of the igniter assembly vary according to the frequency of the high frequency, and therefore, by selecting a high frequency at which the magnitude relationship between the respective measurement values of the first measurement circuit and second measurement circuit is comparatively large, and performing the measurement at this frequency, it is possible to distinguish between the center pin and the eyelet pin without influence from measurement errors.

Example 2

Gas Generator of FIG. 3

The two measurement circuits (first measurement circuit and second measurement circuit) shown in FIGS. 3(*a*) and 3(*b*) were prepared, whereupon the pure resistance value (Ω) and impedance (Ω) were measured while varying the frequency, as shown in Tables 3 and 4. A "Vector Network Analyzer, Model: ZVRE, Frequency Range: 10 kHz to 4 GHz", manufactured by ROHDE & SCHWARZ, Inc. was used as the high-frequency resistance measuring device.

TABLE 3

| Frequency (MHz) | Pure Resistance(Ω) First measurement circuit | Second measurement circuit | Difference |
|---|---|---|---|
| 10 | 188.560 | 185.810 | 2.750 |
| 15 | 111.750 | 106.750 | 5.000 |
| 20 | 81.969 | 79.437 | 2.532 |
| 30 | 48.156 | 47.031 | 1.125 |
| 40 | 36.625 | 35.516 | 1.109 |
| 50 | 28.578 | 27.156 | 1.422 |
| 60 | 22.906 | 21.109 | 1.797 |
| 70 | 19.703 | 18.383 | 1.320 |
| 80 | 17.102 | 16.086 | 1.016 |
| 90 | 15.148 | 14.273 | 0.875 |
| 100 | 14.000 | 13.109 | 0.891 |

TABLE 4

| Frequency (MHz) | Impedance(Ω) First measurement circuit | Second measurement circuit | Difference |
|---|---|---|---|
| 10 | 1633.295 | 1601.979 | 31.316 |
| 15 | 1091.104 | 1063.054 | 28.050 |
| 20 | 828.691 | 809.123 | 19.568 |
| 30 | 560.857 | 549.356 | 11.501 |
| 40 | 421.799 | 411.310 | 10.489 |
| 50 | 335.653 | 327.107 | 8.546 |
| 60 | 276.437 | 270.199 | 6.238 |
| 70 | 232.448 | 227.033 | 5.445 |
| 80 | 198.717 | 193.886 | 4.831 |
| 90 | 171.725 | 167.378 | 4.347 |
| 100 | 149.488 | 145.612 | 3.876 |

As is evident from Tables 3 and 4, a magnitude relationship occurred clearly in both the pure resistance and the impedance between the first measurement circuit (between the metallic cap 36 and the center pin 21*a*) and the second measurement circuit (between the metallic cap 36 and the eyelet pin 21*b*) at each frequency. It is therefore possible to distinguish between the two electroconductive pins of the igniter assembly provided in the gas generator easily. Hence, confusion does not occur between the positive and negative electrodes of the ignition power source that is connected to the two electroconductive pins when incorporating the igniter assembly in a device, and the device can be assembled reliably and easily.

As shown in Tables 3 and 4, the measurement values of the pure resistance and impedance of the igniter assembly vary according to the frequency of the high frequency, and therefore, by selecting a high frequency at which the magnitude relationship between the respective measurement values of the first measurement circuit and second measurement circuit is comparatively large and performing the measurement at this high frequency, it is possible to distinguish between the center pin and the eyelet pin without influence from measurement errors.

As is evident from the high-frequency resistance measurement results shown in Tables 1 to 4, it is possible to distinguish between the two electroconductive pins of an igniter assembly (including a gas generator having an igniter assembly) by measuring either one of the pure resistance and the impedance. It is also possible to distinguish between the two electroconductive pins by measuring both the pure resistance and the impedance.

The invention thus described, it will be obvious that the same may be varied in many ways. Such variations are not to be regarded as a departure from the spirit and scoped of the invention, and all such modifications as would be obvious to one skilled in the art are intended to be included within the scope of the following claims.

The invention claimed is:

1. A method of assembling a device employing electric ignition by comprising assembling an igniter assembly in the device, the igniter assembly having an electric igniter provided with a first electroconductive pin and a second electroconductive pin, connected to a power source, the method comprising steps of:

forming two measurement circuits by using the first electroconductive pin and the second electroconductive pin as a measurement terminal on one end side, respectively, and using another member provided in the igniter assembly as a terminal on the other end side with a pass through a dielectric provided in the igniter assembly, measuring pure resistances and/or impedances of the two measurement circuits, respectively, by applying a high frequency thereto separately, distinguishing the first electroconductive pin from the second electroconductive pin from a magnitude relationship (difference) between the measured pure resistance and/or impedance values, and then, disposing the igniter assembly to the device such that the first electroconductive pin and the second electroconductive pin correspond to predetermined power source electrodes, respectively.

2. The assembly method according to claim 1, wherein the dielectric is an electric insulation cover covering an ignition portion of the electric igniter.

3. The assembly method according to claim 1, wherein the dielectric is a resin which integrally couples a metallic igniter collar to the electric igniter.

4. A method of distinguishing between a first electroconductive pin and a second electroconductive pin, provided in an electric igniter in an igniter assembly including the electric igniter, comprising steps of:

forming two measurement circuits passing through a dielectric, provided in the igniter assembly, such that the first electroconductive pin and the second electroconductive pin serves as a measurement terminal on one end side and another member provided in the igniter assembly serves as a terminal on another end side; and measuring pure resistances and/or impedances of the two measurement circuits, respectively, by applying a high frequency thereto separately, and distinguishing between the first electroconductive pin and the second electroconductive pin from a magnitude relationship (difference) between the measured pure resistance and/or impedance values.

5. The method of distinguishing between a first electroconductive pin and a second electroconductive pin according to claim 4, wherein the dielectric is an electric insulation cover covering an ignition portion of the electric igniter.

6. The method of distinguishing between a first electroconductive pin and a second electroconductive pin according to claim 4, wherein the dielectric is a resin which integrally couples a metallic igniter collar to the electric igniter.

* * * * *